US006564021B1

(12) United States Patent
Nakai et al.

(10) Patent No.: US 6,564,021 B1
(45) Date of Patent: May 13, 2003

(54) IMAGE FORMING APPARATUS WITH TRANSFER VOLTAGE CONTROL FOR TRANSFERRING TONER PATTERNS

(75) Inventors: Tomoaki Nakai, Numazu (JP); Yoichiro Maebashi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/669,901

(22) Filed: Sep. 27, 2000

(30) Foreign Application Priority Data

Sep. 29, 1999 (JP) ..... 11-277588
Sep. 20, 2000 (JP) ..... 2000-285985

(51) Int. Cl.[7] ..... G03G 15/00
(52) U.S. Cl. ..... 399/49; 399/66
(58) Field of Search ..... 399/49, 66, 72, 399/299, 314

(56) References Cited

U.S. PATENT DOCUMENTS 5,508,796 A 4/1996 Sasame et al.
5,600,421 A * 2/1997 Takekoshi et al. ..... 399/299
5,666,597 A 9/1997 Sasame et al. ..... 399/128
6,091,913 A * 7/2000 Suzuki et al. ..... 399/49
6,160,972 A * 12/2000 Shimazu et al. ..... 399/299

* cited by examiner

*Primary Examiner*—Robert Beatty
(74) *Attorney, Agent, or Firm*—Fitzpatrick, Cella, Harper & Scinto

(57) ABSTRACT

An image forming apparatus includes a first image bearing member for bearing an image, a second image bearing member for bearing an image, an intermediate transfer member, wherein, after a plurality of images are sequentially transferred in a first transfer position and a second transfer position from the first image bearing member and the second image bearing member to the intermediate transfer member, the plurality of images on the intermediate transfer member are transferred to a transfer material, and a detector for detecting a first image for detection and a second image for detection transferred from the first image bearing member and the second image bearing member to the intermediate transfer member, wherein the intensity of the electric field formed in the second transfer position when the first image for detection passes through the second transfer position is smaller (e.g. zero) than the intensity of the electric field formed in the second transfer position when the second image for detection is transferred from the second image bearing member to the intermediate transfer member.

34 Claims, 8 Drawing Sheets

FIG. 6

| | DENSITY | TRANSFER BIAS | CAUSE FOR DENSITY REDUCTION |
|---|---|---|---|
| THE EMBODIMENT | 1.32 | 400V ON PATCH TRANSFER AND 0V AFTER PATCH TRANSFER | |
| COMPARATIVE EXAMPLE 1 | 0.92 | 0V REMAINS THE SAME | CAUSED BY LOW TRANSFER EFFICIENCY |
| COMPARATIVE EXAMPLE 2 | 1.14 | 300V REMAINS THE SAME | CAUSED BY LOW TRANSFER EFFICIENCY |
| COMPARATIVE EXAMPLE 3 | 1.12 | 600V REMAINS THE SAME | CAUSED BY RE-TRANSFER |
| COMPARATIVE EXAMPLE 4 | 0.86 | 900V REMAINS THE SAME | CAUSED BY RE-TRANSFER |

FIG. 8A
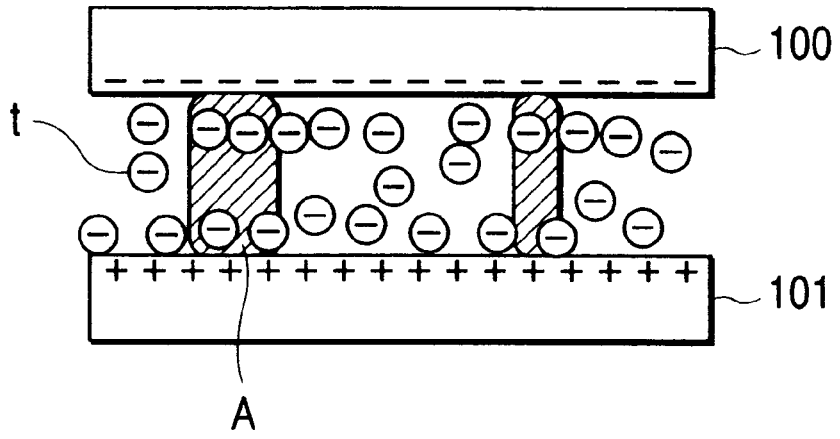
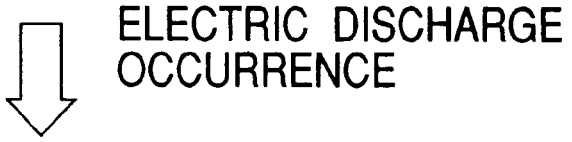
FIG. 8B
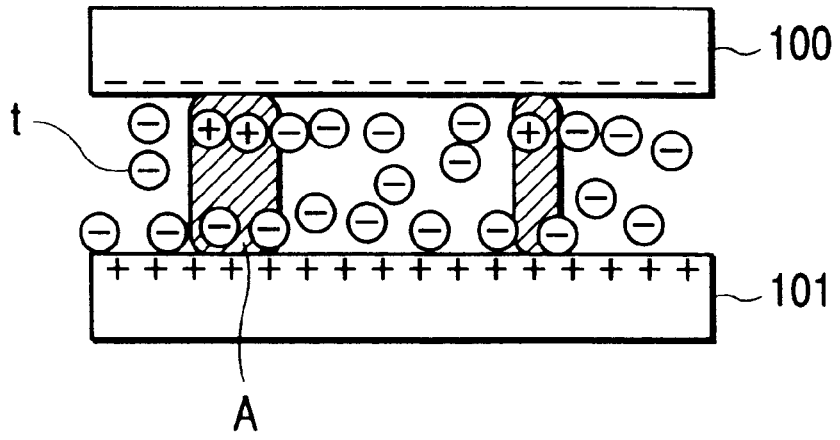

IMAGE FORMING APPARATUS WITH TRANSFER VOLTAGE CONTROL FOR TRANSFERRING TONER PATTERNS

BACKGROUND OF THE INVENTION

1. Field of the Invention

The present invention relates to an image forming apparatus using an electrophotographic process, and relates to an image forming apparatus such as a copying machine, a printer, or a facsimile machine.

2. Related Background Art

In an image forming apparatus which electrophotographically forms an image, the image density varies greatly depending on the environment where the image forming apparatus is placed (temperature, humidity, and the like), the durable time period, the photosensitive member, the variation in the characteristics of the developer, and the like. Particularly, in a color image forming apparatus, the hue or tone also varies.

Therefore, conventionally, a toner pattern for detecting the density (hereinafter referred to as a "patch") is formed from a photosensitive member onto an intermediate transfer member or a transfer material bearing member for bearing a transfer material. By carrying out a density correcting mode for detecting the density of the patch (hereinafter referred to as "patch detection") using a density detecting sensor, conditions of the image forming process such as the charging bias, the developing bias, the exposure dose are controlled to make appropriate the image density.

Further, the density detecting sensor for detecting the patch density is, due to the limited space for attachment, attached to a position opposing to the intermediate transfer member or to the transfer material bearing member.

In an image forming apparatus for forming a full color toner image on the intermediate transfer member using four colors and four photosensitive members, when the above-described patch detection is carried out, a patch in a first color (for example, yellow) comes in contact with the three other photosensitive members after it is transferred from the photosensitive drum to the intermediate transfer member and before its patch density is detected by the density detecting sensor. Here, since the patch formed on the intermediate transfer member comes in contact with the other photosensitive members, part of toner forming the patch may be transferred from the intermediate transfer member to the other photosensitive members, which is referred to as re-transfer (offset).

When such re-transfer is caused, the density of the patch in the first color when it comes to a position opposing to the density detecting sensor becomes lower than that immediately after the transfer to the intermediate transfer member. The same thing can be said also with regard to a second color (for example, magenta) and a third color (for example, cyan) in greater or lesser degrees, and the density when the patch comes to the position opposing to the density detecting sensor becomes lower than that immediately after the patch is transferred from the photosensitve member to the intermediate transfer member. It is to be noted that such re-transfer is also caused in an image forming apparatus using the above-described transfer material bearing member. As a result, the densities of the toner images in the various colors formed on the respective photosensitive drums can not be appropriately controlled, and uneven image density and uneven hue or tone are caused.

It is to be noted that, conventionally, the bias to be applied to a primary transfer charger is set to be the same value both in case the patch is transferred from the photosensitive drum to the intermediate transfer member and in case the patch on the intermediate transfer member comes in contact with other downstream photosensitive drums.

Here, the cause of the above-described re-transfer is described.

As illustrated in FIG. 8A, in a transfer nip portion formed between a photosensitive drum 100 and an intermediate transfer member 101, the surface of the photosensitive drum 100 is, in this case, negatively charged, while the intermediate transfer member 101 is positively charged for the purpose of attracting toner t having negative charge. Further, in the transfer nip portion formed between the photosensitive drum 100 and the intermediate transfer member 101, there may be a case where a region A satisfying conditions for potential difference and gap exceeding a threshold of discharge.

As illustrated in FIG. 8B, when discharge is caused in the region A in the transfer nip portion, charge is exchanged, and positive charge is induced in a part of the toner in the transfer nip portion. Since the surface of the photosensitive drum 100 is negatively charged, as a result, the toner to which the positive charge has been induced on the intermediate transfer member 101 is attracted to the side of the photosensitive drum 100, which leads to the re-transfer. It is to be noted that as the contrast between the potential on the surface of the photosensitive drum 100 and the transfer voltage becomes larger, potential difference exceeding the threshold of discharge (voltage where the discharge starts) is more apt to be caused, and thus, the number of the discharge is increased and the amount of the re-transfer is increased.

FIG. 9 is the result of evaluation of the transfer efficiency and the re-transfer rate when the transfer bias is varied.

In FIG. 9, solid lines denote the transfer efficiency while dotted lines denote the re-transfer rate. Solid black dots (•) plotting the transfer efficiency and the re-transfer rate denote a case where the mass per unit area of the toner (hereinafter referred to as M/S) is small (0.4 $mg/cm^2$ on the photosensitive drum), while crosses X denote a case where M/S is large (0.8 $mg/cm^2$ on the intermediate transfer member). It is to be noted that the transfer efficiency is the ratio of M/S on the photosensitive drum to M/S after the transfer to the intermediate transfer member in percentage, while the re-transfer rate is the ratio of M/S on the intermediate transfer member to M/S on the photosensitive drum after the intermediate transfer member comes in contact with the photosensitive drum in percentage. As the re-transfer rate becomes higher, more toner on the intermediate transfer member moves to the side of the photosensitive drum.

As is apparent from the result shown in FIG. 9, when the transfer bias satisfies the transfer efficiency of M/S=0.8 $mg/cm^2$, the re-transfer rate is poor, while, when the re-transfer rate is satisfactory, the transfer efficiency is bad. In other words, it is thought that the above-described re-transfer is caused because no bias satisfies enough both the transfer efficiency and the re-transfer rate.

In addition, in the above-described image forming apparatus, since a conventional cleaning device dedicated for each photosensitive drum is eliminated and a "cleanerless system" is adopted in which toner remaining on each photosensitive drum is collected into each developing device, when the above-described re-transfer is caused, toner in different colors is collected into the developing device and the color of the toner is mixed in the developing device. As a result, a poor image is formed in image formation thereafter.

SUMMARY OF THE INVENTION

An object of the present invention is to provide an image forming apparatus which can accurately detect an image for detection formed on an intermediate transfer member.

Another object of the present invention is to provide an image forming apparatus which can accurately detect an image for detection formed on a transfer material bearing member.

Other objects of the present invention will become apparent upon consideration of the following detailed description.

BRIEF DESCRIPTION OF THE DRAWINGS

FIG. 6 illustrates the result of evaluation of the transfer efficiency and the re-transfer rate of Embodiment 1;

FIGS. 8A and 8B are explanatory views of re-transfer of toner;

DESCRIPTION OF THE PREFERRED EMBODIMENTS

Embodiments of the present invention are now described with reference to the drawings.

Embodiment 1

Figure 1:
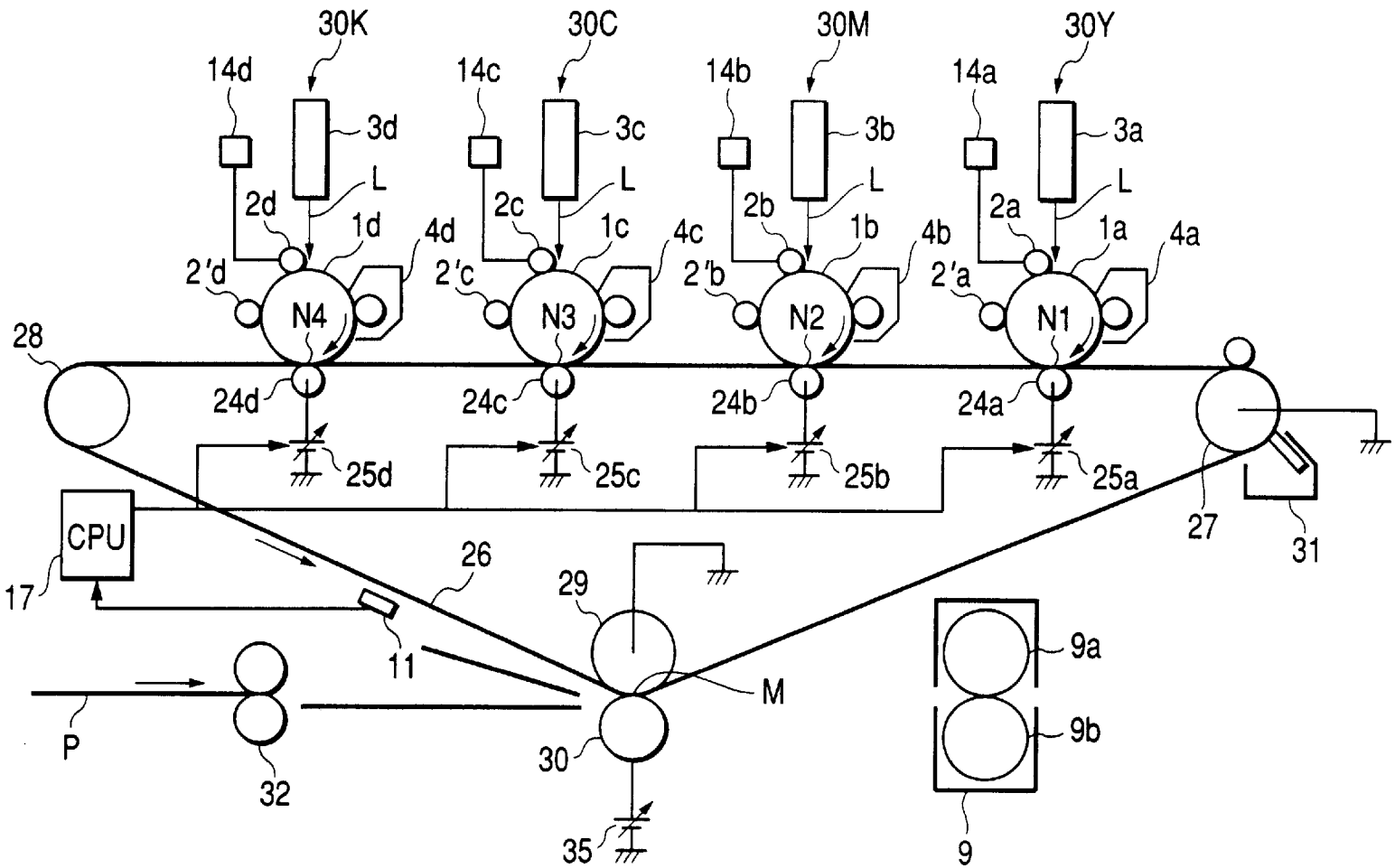
FIG. 1 is a schematic view of an image forming apparatus according to Embodiment 1 of the present invention.

FIG. 1 is a schematic view of an in-line type full color image forming apparatus having four juxtaposed photosensitive members according to an embodiment of the present invention.

The image forming apparatus is provided with four image forming sections: an image forming section 30Y for forming an image in yellow; an image forming section 30M for forming an image in magenta; an image forming section 30C for forming an image in cyan; and an image forming section 30K for forming an image in black. The four image forming sections (image forming units) are arranged in a line at regular intervals (in the present embodiment, the intervals are set to be substantially equal to the perimeter of a driving roller for transmitting rotational driving force to an intermediate transfer belt).

The image forming sections 30Y, 30M, 30C, and 30K are provided with photosensitive drums 1*a*, 1*b*, 1*c*, and 1*d*, respectively, as image bearing members. Charging rollers 2*a*, 2*b*, 2*c*, and 2*d* as charging means, auxiliary chargers 2'*a*, 2'*b*, 2'*c*, and 2'*d* as auxiliary charging means, developing devices 4*a*, 4*b*, 4*c*, and 4*d* as developing means, and primary transfer rollers 24*a*, 24*b*, 24*c*, and 24*d* as transfer charging means are provided around the photosensitive drums 1*a*, 1*b*, 1*c*, and 1*d*, respectively. Exposure devices 3*a*, 3*b*, 3*c*, and 3*d* are disposed above between the charging rollers 2*a*, 2*b*, 2*c*, and 2*d* and the developing devices 4*a*, 4*b*, 4*c*, and 4*d*, respectively.

Yellow toner, cyan toner, magenta toner, and black toner (toner of a negatively charged property) are contained in the developing devices 4*a*, 4*b*, 4*c*, and 4*d*, respectively. The toner in the various colors is manufactured by a polymerizing method, and is capsule type spherical non-magnetic toner having wax encapsulated therein. Developing bias of direct current voltage of −350 V with rectangular waves having the frequency of 2000 Hz and the peak-to-peak voltage of 2000 Vpp superimposed thereon (initial setting) is applied to the respective developing devices (developer bearing members for bearing developer and conveying the developer to developing portions) 4*a*, 4*b*, 4*c*, and 4*d* to develop exposure portions on the surfaces of the photosensitive drums 1*a* to 1*d* with negatively charged toner to visualize electrostatic latent images (reversal development).

In the present embodiment, the photosensitive drums 1*a* to 1*d* are OPC (organic photoconductor) electrophotographic photosensitive drums having the diameter of 62 mm, and an undercoated layer, a charge blocking layer, a charge generation layer, and a charge transport layer are provided on the outer peripheral surface of each aluminum drum. The photosensitive drums 1*a* to 1*d* are rotatably driven in the direction shown by arrows at predetermined velocity (for example, 100 mm/sec). In the rotating process, the photosensitive drums 1*a* to 1*d* are evenly and negatively charged by the charging rollers 2*a* to 2*d* coming in contact therewith, respectively.

The charging rollers 2*a* to 2*d* as the charging means are provided so as to rotatably come in contact with the surfaces of the photosensitive drums 1*a* to 1*d*. The photosensitive drums 1*a* to 1*d* are charged at predetermined polarity and potential by charging bias (initially set to be −500 V) applied from charging bias power sources 14*a* to 14*d* connected to the charging rollers 2*a* to 2*d*, respectively (in the present embodiment, the photosensitive drums 1*a* to 1*d* are negatively charged).

Further, after the primary transfer, the charging rollers 2*a* to 2*d* charge toner remaining on the photosensitive drums 1*a* to 1*d* at the same polarity as a normal charging polarity of the toner. The charged toner remaining on the photosensitive drums 1*a* to 1*d* is electrostatically collected into the developing devices (developer bearing members) 4*a* to 4*d*. In case of continuous image formation, by carrying out development of the electrostatic latent images formed on the photosensitive drums 1*a* to 1*d* simultaneously with the collection of the toner remaining after the primary transfer by the developing devices 4*a* to 4*d*, the throughput of the image formation can be improved.

Before the toner remaining on the photosensitive drums 1*a* to 1*d* is charged by the charging rollers 2*a* to 2*d*, the auxiliary chargers 2'*a* to 2'*d* charges for a time the toner remaining after the primary transfer at the opposite polarity (in the present embodiment, it is positively charged) to the normal charging polarity of the toner. This is for, by positively charging the remaining toner for a time, taking the remaining toner into the charging rollers 2*a* to 2*d* (making the remaining toner attach to the charging rollers 2*a* to 2*d*) to satisfactorily charge portions of the photosensitive drums where the remaining toner exists for latent image formation.

Each of the exposure devices 3*a* to 3*d* has a laser driver, a laser diode, a polygon mirror, and the like. Laser beam modulated corresponding to a time series electric digital image signal of image information inputted to the laser driver is outputted from the laser diode, and the laser beam with the polygon mirror rotating at high speed carries out scanning, and, by image exposure L of the surfaces of the photosensitive drums 1*a* to 1*d* via reflecting mirrors, electrostatic latent images corresponding to the image information are formed.

An intermediate transfer belt 26 as an endless intermediate transfer member is in contact with lower portions of the photosensitive drums 1*a*, 1*b*, 1*c*, and 1*d* in primary transfer portions N1, N2, N3, and N4, respectively. As described in further detail in the following, the contacting state between the respective photosensitive drums and the intermediate transfer belt is maintained even in a density control mode (register control mode). The intermediate transfer belt 26 is stretched around a driving roller 27, a tension roller 28, and a secondary transfer opposite roller 29, and is rotated in a direction shown by an arrow (counterclockwise) by driving of the driving roller 27. The volume resistivity of the intermediate transfer belt 26 is preferably $10^6$ to $10^{12}$ Ω·cm. As the material of the intermediate transfer belt 26, for example, urethane resin, fluoropolymer, nylon resin, polyimide resin, elastic material such as silicone rubber or Hydrin rubber, or the same with carbon or conductive powder dispersed therein to adjust the resistance may be used. In the present embodiment, the intermediate transfer belt 26 is formed of polyimide resin at the thickness of 0.5 mm with carbon dispersed therein to adjust the volume resistivity to be $10^{11}$ Ω·cm.

The primary transfer rollers 24*a*, 24*b*, 24*c*, and 24*d* are formed by coating a core with an elastic member of medium resistance (the actual resistance when a nip is formed in case 1 kV is applied is $10^6$ to $10^{10}$ Ω), and are in contact with the photosensitive drums 1*a*, 1*b*, 1*c*, and 1*d* via the intermediate transfer belt 26 in the primary transfer nip portions N1, N2, N3, and N4, respectively. Primary transfer bias power sources 25*a*, 25*b*, 25*c*, and 25*d* are connected to the primary transfer rollers 24*a*, 24*b*, 24*c*, and 24*d*, respectively. A secondary transfer opposing roller 29 is in contact with a secondary transfer roller 30 via the intermediate transfer belt 26 to form a secondary transfer portion M. The secondary transfer roller 30 is provided so as to freely come in and out of contact with the intermediate transfer belt 26.

A belt cleaning device (a cleaning blade, a remaining toner collecting container) 31 is disposed in proximity to the driving roller 27 which is outside the intermediate transfer belt 26 and in contact with the intermediate transfer belt 26 for removing and collecting toner remaining on the surface of the intermediate transfer belt 26 after the transfer.

Figure 2:
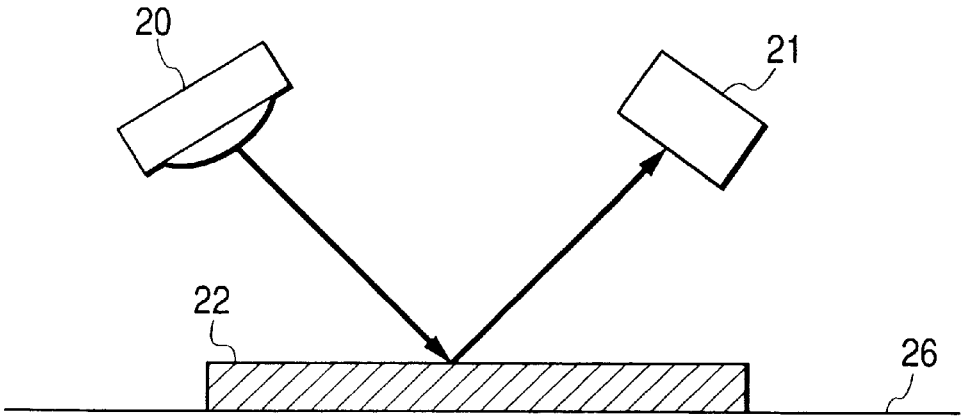
FIG. 2 illustrates the structure of a density detecting sensor.

As illustrated in FIG. 2, a density detecting sensor 11 is provided with a light emitting portion 20 and a light receiving portion 21. Spotlight is irradiated from the light emitting portion 20 of the density detecting sensor 11 onto a patch (a toner pattern for detecting the density) 22 formed on the surface of the intermediate transfer belt 26, the reflected light is received by the light receiving portion 21, and an electric signal corresponding to the amount of the received light is sent to a controller (CPU) 17. The controller (CPU) 17 varies the conditions of the image formation such as the intensity of exposure by the exposure device, the charging bias applied to the charging roller 2, and the developing bias applied to the developer bearing member (developing sleeve) of the developing device 4 based on the electric signal inputted from the light receiving portion 21 of the density detecting sensor 11 to control appropriately the density of a toner image formed on the photosensitive drum (detailed description is made in the following).

Further, the primary transfer bias power sources 25*a* to 25*d* for applying primary transfer bias to the primary transfer rollers 24*a* to 24*d* and the bias power sources 14*a* to 14*d* for applying the charging bias to the charging rollers 2*a* to 2*d* are connected to the controller 17, such that the charging bias for charging the photosensitive drum 1, the primary transfer bias for transferring to the intermediate transfer belt 26 the patches in the various colors formed on the photosensitive drums 1*a* to 1*d*, and the bias applied when the patches in the various colors transferred to the intermediate transfer belt 26 pass through other downstream primary transfer portions (when they come in contact with the surfaces of other photosensitive drums) to the primary transfer rollers of the other downstream primary transfer portions are varied through control by the controller 17 (detailed description is made in the following).

Further, a fixing device 9 having a fixing roller 9*a* and a pressure roller 9*b* is disposed downstream of the secondary transfer portion in the direction of conveyance of a transfer material P.

Next, image forming operation by the above described image forming apparatus is described.

When an image forming operation start signal is generated, a transfer material (paper piece) P is fed one by one to be conveyed to a register roller 32. Here, the rotation of the register roller 32 is stopped and the leading end of the transfer material P waits immediately in front of the secondary transfer portion M. After that, the register roller 32 starts to rotate such that the transfer material P reaches the secondary transfer portion when toner images in the various colors formed by the image forming sections 30Y, 30M, 30C, and 30K reach the secondary transfer portion.

On the other hand, when the image forming operation start signal is generated, in the image forming sections 30Y, 30M, 30C, and 30K, the photosensitive drums 1*a*, 1*b*, 1*c*, and 1*d* rotatably driven at a predetermined process speed are evenly charged to the negative polarity by the charging rollers 2*a*, 2*b*, 2*c*, and 2*d*, respectively. The exposure devices 3*a*, 3*b*, 3*c*, and 3*d* convert inputted color separated image signals into optical signals at their laser output portions, and the charged photosensitive drums 1*a*, 1*b*, 1*c*, and 1*d* are exposed to and scanned by laser beams as the converted optical signals to form electrostatic latent images.

Then, first, toner in yellow (in the present embodiment, the normal charging polarity of the toner is the negative polarity) is attached to the electrostatic latent image formed on the photosensitive drum 1*a* by the developing device (developing sleeve) 4a to which the developing bias having the same polarity as that of the charged polarity (negative polarity) of the photosensitive drum 1*a* is applied to visualize the image as a toner image. The yellow toner image is primarily transferred in the primary transfer portion N1 onto the rotating intermediate transfer belt 26 by the primary transfer roller 24*a* to which the primary transfer bias (voltage having the opposite polarity (positive) to that of the toner) is applied from the primary transfer bias power source 25*a*.

The intermediate transfer belt 26 with the yellow image transferred thereto is rotated on the side of the image forming section 30M. Then, in the image forming section 30M, in the same way as that described in the above, a magenta image formed on the photosensitive drum 1*b* is transferred in the primary transfer portion N2 so as to be superimposed on the yellow image on the intermediate transfer belt 26.

The same is repeated, and cyan and black images formed on the photosensitive drums 1*c* and 1*d* in the image forming sections 30C and 30K are sequentially superimposed in the primary transfer portions N3 and N4 on the yellow and magenta images transferred and superimposed on the intermediate transfer belt 26 to form a full color image on the intermediate transfer belt 26.

Then, the transfer material P is conveyed to the secondary transfer portion M by the register roller 32 in registration with a time when the leading end of the full color image on the intermediate transfer belt 26 is moved to the secondary transfer portion M, and the full color image is collectively and secondarily transferred to the transfer material P by the secondary transfer roller 30 to which secondary transfer bias (voltage having the opposite polarity (positive) to that of the toner) is applied.

The transfer material P with the full color image formed thereon is conveyed to the fixing device 9, and the full color image is heated and pressurized in a fixing nip portion between the fixing roller 9*a* and the pressure roller 9*b* to thermally fix the image on the surface of the transfer material P. After that, the transfer material P is discharged to the outside.

After the primary transfer, toner remaining after the primary transfer on the photosensitive drums 1*a* to 1*d* are charged by the charging rollers 2*a* to 2*d* at the same polarity as the normal charging polarity of the toner, and electrostatically collected into the developing devices 4*a* to 4*d*. In case of continuous image formation, by carrying out the development of the electrostatic latent images formed on the photosensitive drums simultaneously with the collection of the toner remaining after the primary transfer by the developing devices, the throughput of the image formation can be improved.

Toner remaining after the secondary transfer on the intermediate transfer belt 26 is removed and collected by the belt cleaning device 31.

In case of monochrome image formation or image formation in two or three color mode, only the image forming section(s) for image formation in the necessary color(s) is/are operated.

Next, the density control mode is described. The density control mode is controlled by the controller so as to be carried out every time after image formation is carried out on a predetermined number of (for example, a hundred) transfer materials (the same can be said with regard to a register control mode to be described in the following).

Figure 3:
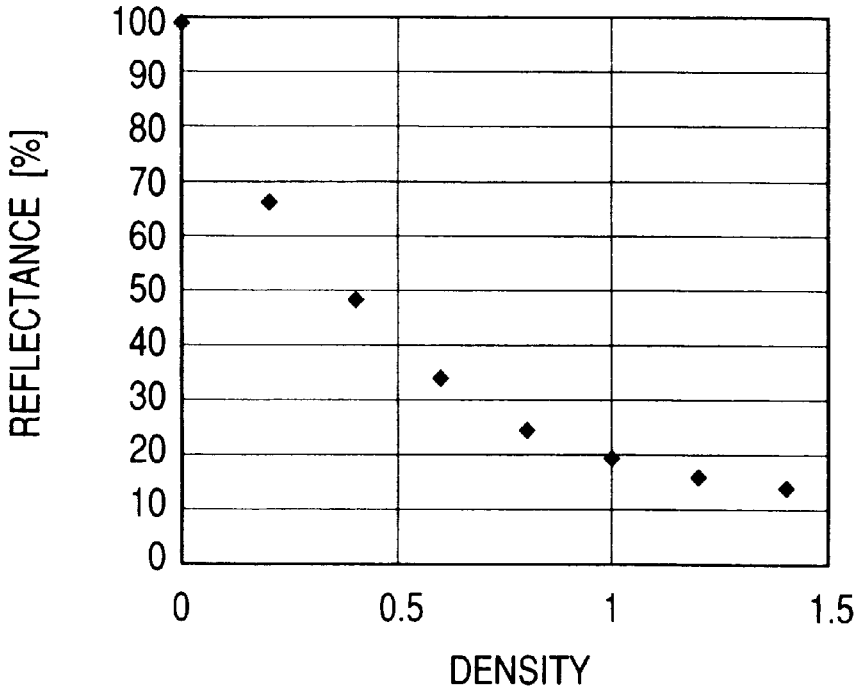
FIG. 3 illustrates the relationship between the density and the reflectance.

FIG. 3 illustrates the relationship between the density and the reflectance. It is to be noted that, in FIG. 3, the reference reflectance (100%) is the amount of light which enters the light receiving portion 21 with no toner on the intermediate transfer belt 26.

When the toner bearing amount on the intermediate transfer belt 26 is zero, the reflectance is 100%. As the toner bearing amount increases, since light emitted from the light emitting portion 20 is scattered by the toner, the amount of light regularly reflected to enter the light receiving portion 21 decreases to lower the reflectance. Conversion from the reflectance to the toner density can be carried out using a conversion table or the like, and the reflectance and the density are in a one-to-one relationship. Therefore, actually, in the density detection control, no conversion to the toner density is carried out.

Figure 4:
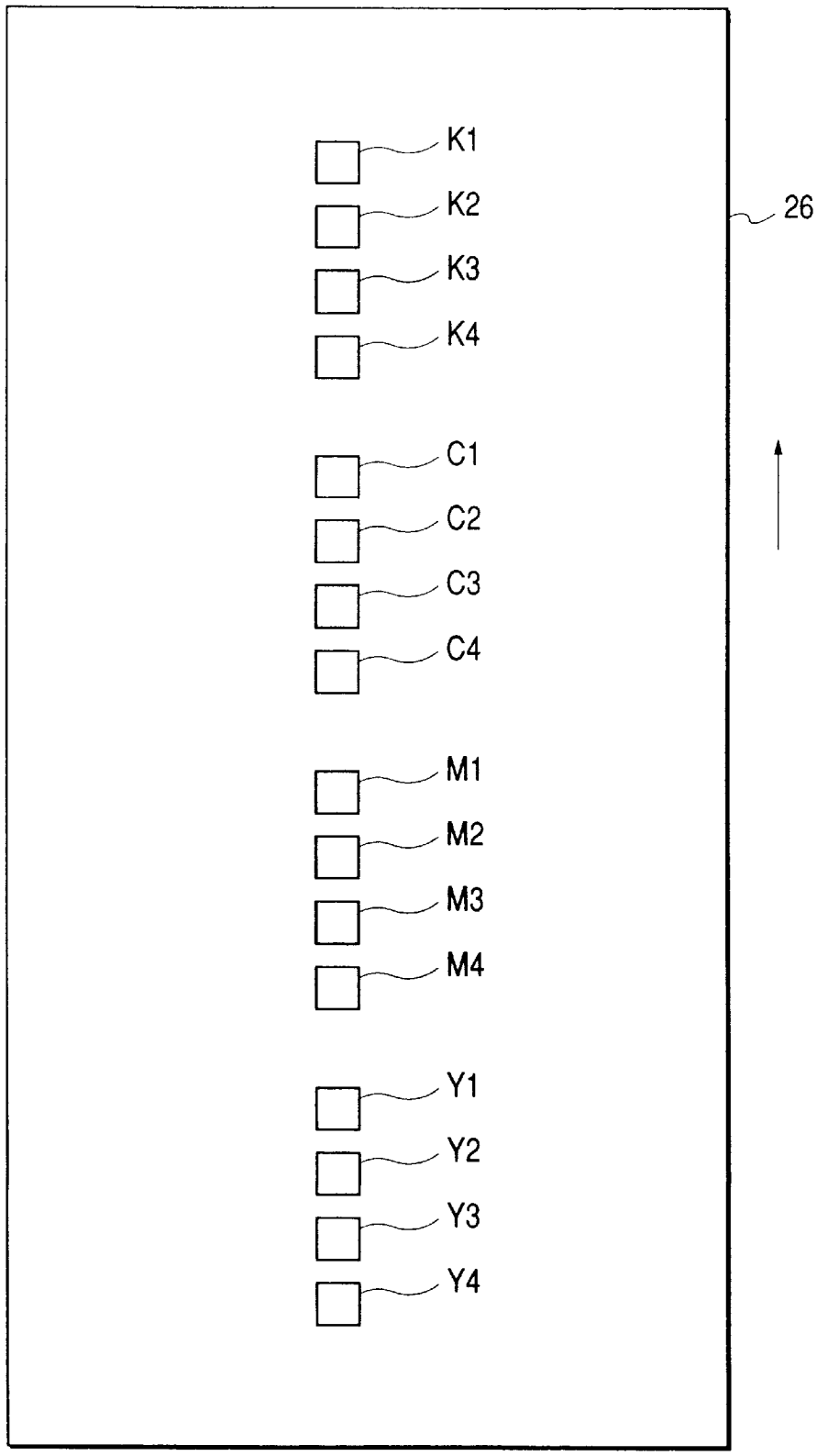
FIG. 4 illustrates an intermediate transfer belt spread in a circumferential direction.

FIG. 4 is a schematic view of the intermediate transfer belt 26 spread in a circumferential direction.

In FIG. 4, Y1 to Y4 are images (patches) for detection when the developing bias with regard to yellow is set to be in four stages of −100 V, −150 V, −200 V, and −250 V to vary the density. These patches are sized to be 2 cm×2 cm. Similarly, M1 to M4, C1 to C4, and K1 to K4 are test toner images for detection in magenta, cyan, and black, respectively. It is to be noted that the patches for the density detection are formed so as not to overlap one another, and the direction of movement of the intermediate transfer belt 26 is shown by an arrow in the figure.

In the direction of movement of the intermediate transfer belt 26, the distance from the leading end of Y1 to the trailing end of Y4 is set to be shorter than the distance between adjacent primary transfer portions. Similarly, the distance from the leading end of M1 to the trailing end of M4, the distance from the leading end of C1 to the trailing end of C4, and the distance from the leading end of K1 to the trailing end of K4 are set to be shorter than the distance between adjacent primary transfer portions (the distance between N1 and N2, the distance between N2 and N3, and the distance between N3 and N4 are set to be substantially equal to one another).

In the present embodiment, since the distance between the patch leading end and the patch trailing end in each color and the distance between adjacent primary transfer portions are set as described in the above, the patches in the various colors formed on the photosensitive drums 1*a* to 1*d* can be transferred to the intermediate transfer belt 26 substantially at the same time (the time periods of the patch transfer process from the start to the end of the transfer of the patches of the various colors from the photosensitive drums to the intermediate transfer belt overlap one another). In other words, at the time when the transfer of the patches (for example, Y1 to Y4) from the photosensitive drum to the intermediate transfer belt is completed, the patch leading end (for example, Y1) on the intermediate transfer belt has not reached the adjacent downstream primary transfer portion (for example, N2).

Here, after the transfer of the patches (for example, M1 to M4) from the photosensitive drum to the intermediate transfer belt is completed and before the patches (for example, Y1 to Y4) on the intermediate transfer belt formed in an upstream image forming section (for example, 30Y) reach the primary transfer portion (for example, N2), voltage applied from the power source 25 (for example, 25*b*) to the primary transfer roller 24 (for example, 24*b*) is switched by the controller from the voltage applied when the patches (for example, M1 to M4) are transferred to the voltage applied for the purpose of preventing re-transfer.

Since the voltage applied from the respective power sources 25 to the respective primary transfer rollers 24 is switched by the controller from the voltage applied when the patches are transferred to the voltage applied for the purpose of preventing re-transfer substantially at the same time (timing) after the transfer of the patches from the photosensitive drum to the intermediate transfer belt is completed and before the patches on the intermediate transfer belt formed in an upstream image forming section reach the primary transfer portion, switching control by the controller becomes easy. Therefore, time necessary for the density control mode (time from the start to the end of the density control mode) can be made as short as possible.

As described in the above, the effectiveness is particularly great when the power source is shared instead of providing discrete power sources for applying voltage to the primary transfer rollers 24*a* to 24*d*, respectively. More specifically, for example, when one common power source is used to apply voltage to the respective primary transfer rollers 24*a* to 24*d*, the switch of the bias to the primary transfer rollers can be carried out substantially at the same time, and thus, the effectiveness is particularly great.

When the density control mode interrupts before image formation on a plurality of transfer materials is completed, since the time between the start of the density control mode and the start of formation of an ordinary image on the next transfer material can be made shorter, lowering of the throughput in image formation can be prevented. Further, the necessary capacity for data and programs to be stored in a ROM or the like connected to the controller as memory means (data and programs with regard to the density control mode) provided in the image forming apparatus can be suppressed, and therefore, the cost can be lowered and the processing speed can be improved.

Figure 5:
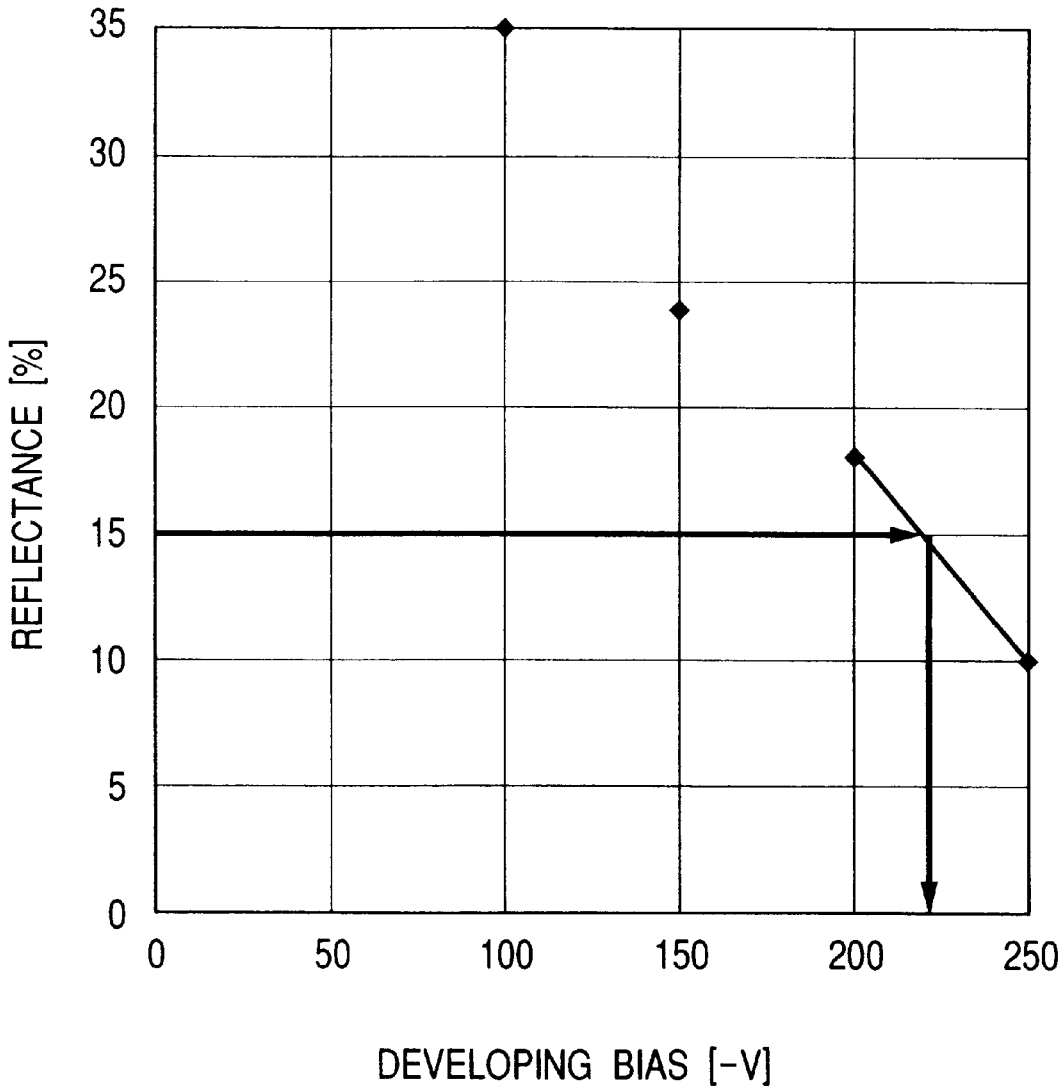
FIG. 5 illustrates the relationship between the developing bias and the reflectance.

In the present embodiment, by applying from the power sources 25*a* to 25*d* to the rollers 24*a* to 24*d* the transfer voltage which is the same as that of ordinary image formation, the patches Y1 to Y4, M1 to M4, C1 to C4, and K1 to K4 in the various colors are transferred from the photosensitive drums to the intermediate transfer belt, and the density detecting sensor 11 sequentially detects the density of the patches Y1 to Y4, M1 to M4, C1 to C4, and K1 to K4 in the various colors. It is to be noted that the patch transfer is carried out under the conditions which are the same as those of ordinary image formation because the purpose is to adjust the density of toner images when an image is actually formed. FIG. 5 illustrates the relationship between the developing bias and the reflectance with regard to the above-described yellow patches Y1 to Y4. In the present embodiment, the developing bias is controlled by the controller 17 such that the density is 1.4.

As shown in FIG. 3, the reflectance leading to the density of 1.4 is about 15%. Linear correction of the developing bias and the reflectance with regard to the respective patches reveals that the developing bias leading to the reflectance of 15% is about −220 V. Similarly, the developing bias leading to the density of 1.4 can be found also with regard to the magenta, cyan, and black toner. In this way, stable density can be secured independently of the fluctuation of the environment and of the durability.

Next, an evaluation experiment of the transfer efficiency and the re-transfer rate was made, with the transfer bias applied from the power sources 25*a* to 25*d* to the rollers 24*a* to 24*d* when the patches formed on the photosensitive drums 1*a* to 1*d* are transferred to the intermediate transfer belt 26 and the bias applied from the power sources 25*a* to 25*d* to the rollers 24*a* to 24*d* when the patches transferred to the intermediate transfer belt 26 come in contact with a downstream photosensitive drum surface (when the patches pass through a downstream primary transfer portion) being varied.

FIG. 6 illustrates the result of the evaluation in the experiment. The bias applied from the power sources 25*a* and 25*b* to the rollers 24*a* and 24*b* is changed as shown in FIG. 6, and the transfer efficiency of the yellow patches from the photosensitive drum 1*a* to the intermediate transfer belt 26 and the re-transfer rate of the yellow patches from the intermediate transfer belt 26 to the photosensitive drum 1*b* are evaluated as shown.

In the experiment, according to the present embodiment, the controller 17 carried out the switch such that the transfer bias to the roller 24*a* when the patches were transferred from the photosensitive drum 1*a* to the intermediate transfer belt 26 was 400 V and the bias applied to the roller 24*b* when the patches transferred to the intermediate transfer belt 26 came in contact with the next photosensitive drum 1*b* was 0 V. More specifically, the controller 17 switches the bias applied from the power source 25*b* to the roller 24*b* from 400 V to 0 V after the transfer of the magenta toner patches from the photosensitive drum 1*b* to the intermediate transfer belt 26 was completed and before the yellow toner patches on the intermediate transfer belt 26 reached the primary transfer portion N2. It is to be noted that the absolute value of the bias applied to the primary transfer roller 24 when the patches transferred to the intermediate transfer belt 26 come in contact with a downstream photosensitive drum is smaller than that of the bias applied to the primary transfer roller 24 when the patches are transferred from the downstream photosensitive drum to the intermediate transfer belt. Further, when the patches transferred to the intermediate transfer belt 26 pass through a downstream primary transfer portion, the surface of the photosensitive drum which comes in contact with the patches are charged by the charging roller 2, and exposure operation by the exposure device is not carried out.

Since the controller carries out control such that the intensity of the electric field formed in the primary transfer portion when the patches transferred to the intermediate transfer belt 26 come in contact with a downstream photosensitive drum is smaller than the intensity of the electric field formed in the primary transfer portion when the patches are transferred from the downstream photosensitive drum to the intermediate transfer belt, re-transfer of the patches on the intermediate transfer belt to the photosensitive drum can be prevented.

It is to be noted that to make the intensity of the electric field formed in the primary transfer portion when the patches transferred to the intermediate transfer belt 26 come in contact with a downstream photosensitive drum smaller than the intensity of the electric field formed in the primary transfer portion when the patches are transferred from the downstream photosensitive drum to the intermediate transfer belt can be attained through control by the controller of at least one of the bias applied from the power source 25 to the primary transfer roller and the bias applied from the power source 14 to the charging roller 2.

The transfer bias power source 25*b* was switched by the controller 17 such that the bias applied to the roller 24*b* was 0 V both when the patches were transferred and after the patches were transferred in Comparative Example 1, the bias applied to the roller 24*b* was 300 V both when the patches were transferred and after the patches were transferred in Comparative Example 2, the bias applied to the roller 24*b* was 600 V both when the patches were transferred and after the patches were transferred in Comparative Example 3, and the bias applied to the roller 24*b* was 900 V both when the patches were transferred and after the patches were transferred in Comparative Example 4.

As is apparent from the result of the evaluation, the transfer efficiency of the yellow toner patches from the photosensitive drum 1*a* to the intermediate transfer belt was low in Comparative Examples 1 and 2 where the bias when the yellow toner patches were transferred was low, while the re-transfer rate of the yellow toner patches from the intermediate transfer belt to the photosensitive drum 1*b* was high in Comparative Examples 3 and 4 where the bias when the yellow toner patches were transferred was high. It can be seen that, as a result, before the detection by the sensor 11, the density of the yellow toner patches on the intermediate transfer belt is lower than that of the present embodiment.

Accordingly, in the present embodiment, the density can be detected accurately even with regard to highly dense patches for detection which are transferred from a photosensitive drum to the intermediate transfer belt.

Further, according to the present embodiment, since the re-transfer can be prevented from occurring, mixing of the colors of toner collected into the developing devices can be prevented, and thus, poor image formation can be prevented from occurring thereafter.

Still further, though, in the present embodiment, only the bias applied from the power source 25 to the primary transfer roller 24 is changed between the case where the patches are transferred from the photosensitive drum to the intermediate transfer belt and the case where the patches on the intermediate transfer belt come in contact with a downstream photosensitive drum, as described in the above, similar effects can be obtained by controlling and switching only the charging bias applied from the power source 14 to the charging roller 2. Further, similar effects can be obtained by controlling and switching both the bias applied from the power source 25 to the primary transfer roller 24 and the charging bias applied from the power source 14 to the charging roller 2. More specifically, by controlling the difference between the voltage applied from the power source 25 to the primary transfer roller 24 and the voltage applied from the power source 14 to the charging roller 2 using the controller, the transfer efficiency of the patches from the photosensitive drum to the intermediate transfer belt can be improved and re-transfer of the patches from the intermediate transfer belt to the photosensitive drum can be prevented.

It is to be noted that, in the present embodiment, since the relationship between the voltage applied from the power source 14 to the charging roller and the potential on the surface of the photosensitive drum charged by the charging roller is known from experiments, to control using the controller the difference between the voltage applied from the power source 25 to the intermediate transfer belt and the voltage applied from the power source 14 to the charging roller is sufficient.

In case the relationship between the voltage applied from the power source 14 to the charging roller and the potential on the surface of the photosensitive drum charged by the charging roller does not conform to the result of the experiments (the initial setting of the apparatus) due to the long period in use (an endurance condition), a potential sensor (connected to the controller) for detecting the potential on the surface of the photosensitive drum charged by the charging roller 2 may be provided to control the difference between the potential detected by the potential sensor and the voltage applied from the power source 25 to the primary transfer roller 24 using the controller.

Further, though, in the above description, the density control mode is described, the present invention can be applied similarly to the register control mode.

In the register control mode, the toner images for detection in the various colors (register patches) are transferred to the intermediate transfer member such that their positions are registered on the intermediate transfer member. The register patches in the various colors are, for example, combinations of line-shaped toner images (cross marks or the like). Similarly to the case of the above-described density detection, an optical sensor comprising an LED as a light emitting portion and a photodiode as a light receiving portion is used. By calculating a peak of the output of the sensor (for example, a position where the two lines of a cross mark intersect each other), the center position of a register patch in the various colors is detected. After the positions of the register patches in the various colors are detected, the timing of starting to form electrostatic latent images on the respective photosensitive drums by the respective exposure devices (in the main scanning direction and/or in the sub-scanning direction) is controlled such that the positions of the toner images in the various colors transferred from the photosensitive drums to the intermediate transfer belt are registered. More specifically, control for registering the patches in the various colors is carried out by changing the timing of laser writing by the exposure devices or the like.

If the density of the register patches decreases due to the above-described re-transfer phenomenon, the center positions of the register patches which are actually detected are misaligned with the positions where the centers of the register patches should be, and thus, the accuracy of the register control is lowered, and in the worst case, the register control can not be carried out.

However, if the necessary procedures are taken with regard to the register patches in the same way as the re-transfer of the density patches is prevented in the present embodiment as described in the above, the re-transfer of the register patches can be prevented and the accuracy of the register control is prevented from decreasing.

Embodiment 2

Figure 7:
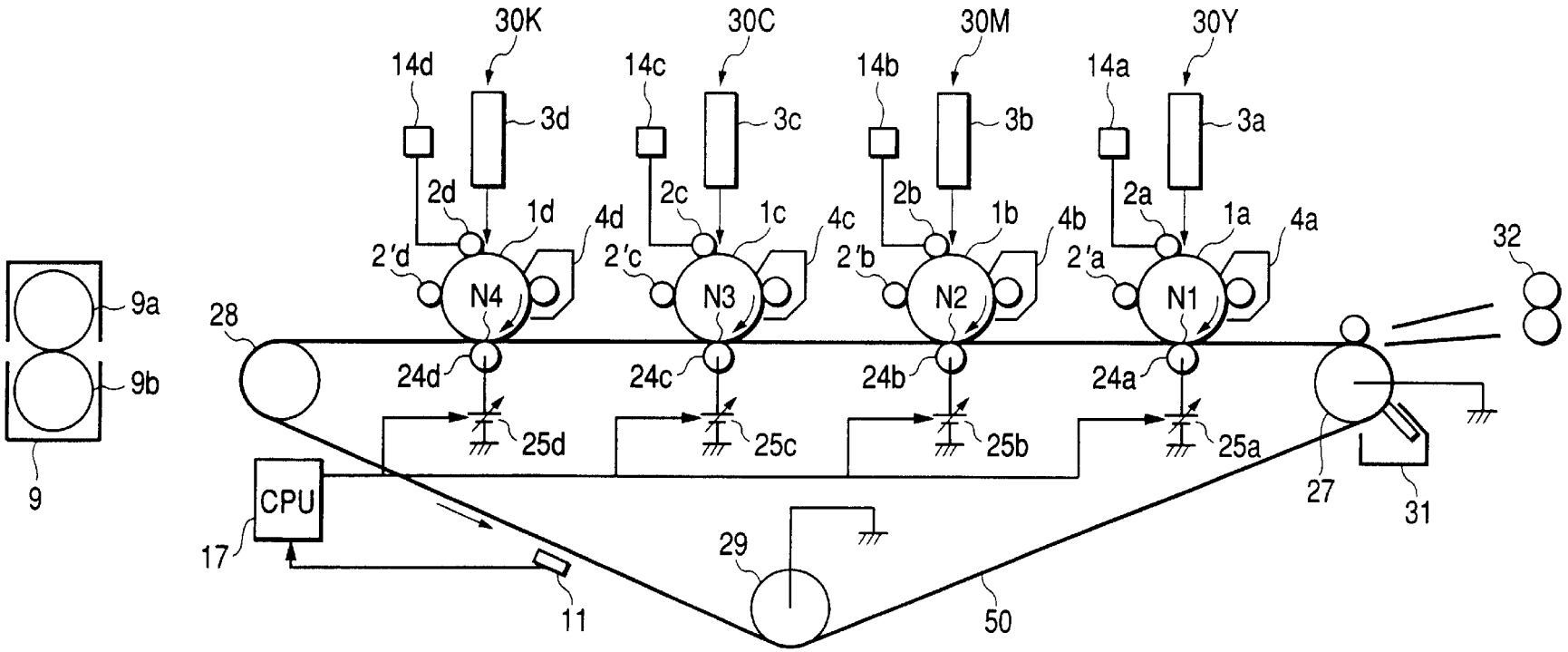
FIG. 7 is a schematic view of an image forming apparatus according to Embodiment 2 of the present invention.
Figure 9:
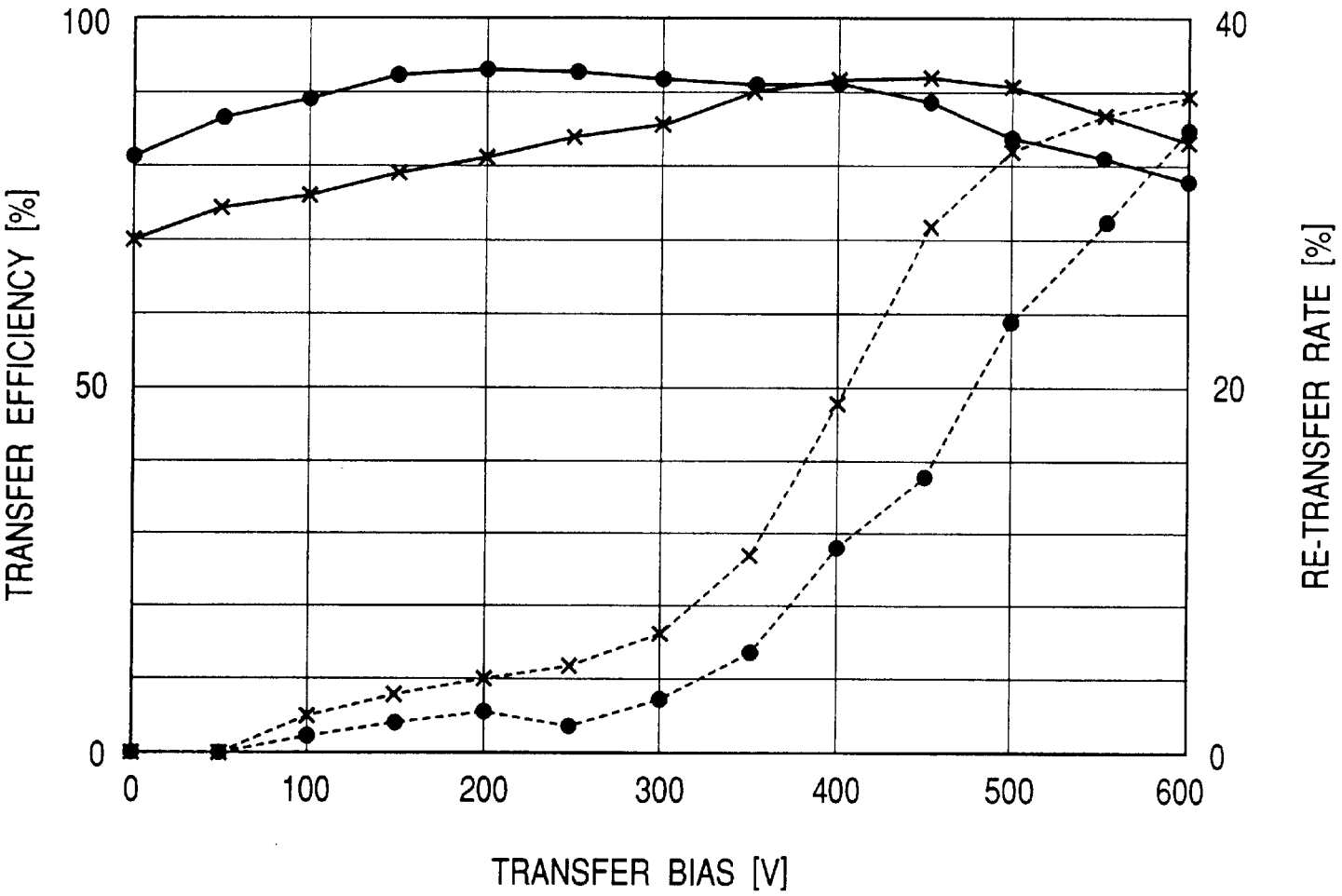
FIG. 9 illustrates the transfer efficiency and the re-transfer rate in relation to the transfer bias.

FIG. 7 is a schematic view of an in-line type full color image forming apparatus having four juxtaposed photosensitive members. FIG. 7 is substantially identical with FIG. 1 except that the image forming apparatus shown in FIG. 7 "transfers toner images on photosensitive members to a transfer material borne by a transfer material bearing member (transfer belt)." Therefore, in FIG. 7, like reference numerals designate members having the same functions as those shown in FIG. 1, and the detailed description thereof is omitted. It is to be noted that, as described in the following, the transfer belt is structured to be in contact with the respective photosensitive drums in the density control mode (register control mode) and when an image is transferred.

An image forming process is briefly described in the following.

When an image forming signal is inputted, first, toner image forming operation on the photosensitive drum 1*a* is started. More specifically, the charging roller 2*a* starts to charge the photosensitive drum 1*a* (in the present embodiment, the photosensitive drum 1 is negatively charged), the exposure device 3*a* carries out exposure of the charged photosensitive drum 1*a* based on the image information, and an electrostatic latent image for the yellow color is formed on the photosensitive drum 1*a*. After that, the electrostatic latent image on the photosensitive drum 1*a* is developed (reversal development) by the developing device 4*a* using yellow toner (toner of a negatively charged property) to form a yellow toner image on the photosensitive drum 1*a*.

Then, the yellow toner image on the photosensitive drum 1*a* is transferred in the transfer portion N1 by the transfer roller 24*a* to the transfer material borne and conveyed by a transfer belt 50 as the transfer material bearing member. Here, voltage having a positive polarity (voltage having the opposite polarity to the normal charging polarity of the toner) is applied from the power source 25*a* to the transfer roller 24*a*.

Such a series of processes from the latent image forming process to the developing process are sequentially carried out similarly with regard to the other image forming sections 30M, 30C, and 30K, and the toner images in the various colors on the respective photosensitive drums are sequentially transferred on the transfer material so as to be superimposed on one another.

After the transfer process to the transfer material is completed, the transfer material is separated from the transfer belt 50 and is conveyed to the fixing device. After the toner image which has not fixed is heated and pressurized to be fixed on the transfer material by the fixing device, the transfer material is discharged outside the apparatus, and a series of image forming processes end.

Contaminant on the transfer belt is removed and collected by the cleaning device 31. On the other hand, toner remaining on the respective photosensitive drums after the transfer is, similarly to the case of Embodiment 1, electrostatically collected into the developing devices, and the developing devices also serve as the cleaning devices of the photosensitive drums. In other words, conventional cleaning devices dedicated for the respective photosensitive drums (cleaning blades or the like) are not provided.

Similarly to the case of Embodiment 1 described in the above, the present invention can also be applied to the density control mode of the image forming apparatus adopting the transfer belt 50.

The controller (CPU) 17 varies the conditions of the image formation such as the intensity of exposure by the exposure device, the charging bias applied to the charging roller 2, and the developing bias applied to the developer bearing member (developing sleeve) of the developing device 4 based on the electric signal inputted from the light receiving portion 21 of the density detecting sensor 11 to control appropriately the density of a toner image formed on the photosensitive drum.

In the density control mode, the bias applied to the respective transfer rollers 24 is switched by the controller 17 such that the density of the patches in the various colors which have been directly transferred from the respective photosensitive drum 1*a* to 1*d* onto the transfer belt 50 is not decreased due to the above-described re-transfer phenomenon before the patches reach the detecting sensor 11.

More specifically, similarly to the case of Embodiment 1, the patches Y1 to Y4, M1 to M4, C1 to C4, and K1 to K4 are transferred from the respective photosensitive drums 1*a* to 1*d* to the transfer belt 50. Here, in the direction of movement of the transfer belt 50, the distance from the leading end of Y1 to the trailing end of Y4 is set to be shorter than the distance between adjacent transfer portions (the distance between N1 and N2, the distance between N2 and N3, and the distance between N3 and N4 are set to be substantially equal to one another). Similarly, the distance from the leading end of M1 to the trailing end of M4, the distance from the leading end of C1 to the trailing end of C4, and the distance from the leading end of K1 to the trailing end of K4 are set to be shorter than the distance between adjacent transfer portions.

In the present embodiment also, since the distance between the patch leading end and the patch trailing end in each color and the distance between adjacent transfer portions are set as described in the above, the patches in the various colors formed on the respective photosensitive drums 1*a* to 1*d* can be transferred to the transfer belt 50 substantially at the same time (the time periods of the patch transfer process from the start to the end of the transfer of the patches in the various colors from the respective photosensitive drums to the transfer belt overlap one another). In other words, at the time when the transfer of the patches (for example, Y1 to Y4) from the photosensitive drum to the transfer belt is completed, the patch leading end (for example, Y1) on the transfer belt has not reached the adjacent downstream transfer portion (for example, N2).

More specifically, after the transfer of the patches (for example, M1 to M4) from the photosensitive drum to the transfer belt is completed and before the patches (for example, Y1 to Y4) on the transfer belt formed in an upstream image forming section (for example, 30Y) reach the transfer portion (for example, N2), voltage applied from the power source 25 (for example, 25*b*) to the transfer roller 24 (for example, 24*b*) is switched by the controller from the voltage applied when the patches (for example, M1 to M4) are transferred to the voltage applied for the purpose of preventing re-transfer.

Since the voltage applied from the respective power sources 25 to the respective transfer rollers 24 is switched by the controller from the voltage applied when the patches are transferred to the voltage applied for the purpose of preventing re-transfer substantially at the same time (timing) after the transfer of the patches from the photosensitive drum to the transfer belt is completed and before the patches on the transfer belt formed in an upstream image forming section reach the transfer portion, switching control by the controller becomes easy. Therefore, time necessary for the density control mode (time from the start to the end of the density control mode execution) can be made as short as possible.

When the density control mode interrupts before image formation on a plurality of transfer materials is completed, since the time between the start of the execution of the density control mode and the start of formation of an ordinary image on the next transfer material can be made shorter, lowering of the throughput in image formation can be prevented. Further, the necessary capacity for data and programs or the like to be stored in a ROM or the like connected to the controller as a memory means (data and programs with regard to the density control mode) provided in the image forming apparatus can be suppressed, and therefore, the cost can be lowered and the processing speed can be improved.

In the present embodiment, by applying from the power sources 25*a* to 25*d* to the rollers 24*a* to 24*d* the transfer voltage which is the same as that of ordinary image formation, the patches Y1 to Y4, M1 to M4, C1 to C4, and K1 to K4 in the various colors are transferred from the photosensitive drums to the transfer belt, and the density detecting sensor 11 sequentially detects the density of the patches Y1 to Y4, M1 to M4, C1 to C4, and K1 to K4 in the various colors. It is to be noted that the patch transfer is carried out under the conditions which are the same as those of ordinary image formation because the purpose is to adjust the density of toner images when an image is actually formed.

Detailed description is as follows. The controller 17 switches the bias applied from the power source 25*b* to the roller 24*b* from 400 V to 0 V after the transfer of the magenta toner patches from the photosensitive drum 1*b* to the transfer belt 50 was completed and before the yellow toner patches on the transfer belt 50 reached the transfer portion N2. It is to be noted that the absolute value of the bias applied to the transfer roller 24 when the patches transferred to the transfer belt 50 come in contact with the other downstream photosensitive drum is smaller than that of the bias applied to the transfer roller 24 when the patches are transferred from the photosensitive drum to the transfer belt.

Further, when the patches transferred to the transfer belt 50 pass through the other downstream transfer portion, the surface of the photosensitive drum which come in contact with the patches are charged by the charging roller 2, and exposure operation by the exposure device is not carried out.

Since the controller carries out control such that the intensity of the electric field formed in the transfer portion when the patches transferred to the transfer belt 50 come in contact with the other downstream photosensitive drum is smaller than the intensity of the electric field formed in the transfer portion when the patches are transferred from the photosensitive drum to the transfer belt, re-transfer of the patches on the transfer belt to the photosensitive drum can be prevented.

It is to be noted that to make the intensity of the electric field formed in the transfer portion when the patches transferred to the transfer belt 50 come in contact with the other downstream photosensitive drum smaller than the intensity of the electric field formed in the transfer portion when the patches are transferred from the other downstream photosensitive drum to the transfer belt can be attained through control by the controller of at least one of the bias applied from the power source 25 to the transfer roller 24 and the bias applied from the power source 14 to the charging roller 2.

More specifically, by controlling the difference between the voltage applied from the power source 25 to the transfer roller 24 and the voltage applied from the power source 14 to the charging roller 2 using the controller, the transfer efficiency of the patches from the photosensitive drum to the transfer belt can be improved and re-transfer of the patches from the transfer belt to the photosensitive drum can be prevented.

It is to be noted that, in the present embodiment, since the relationship between the voltage applied from the power source 14 to the charging roller and the potential on the surface of the photosensitive drum charged by the charging roller is known from experiments, to control using the controller the difference between the voltage applied from the power source 25 to the transfer belt and the voltage applied from the power source 14 to the charging roller is sufficient.

In case the relationship between the voltage applied from the power source 14 to the charging roller and the potential on the surface of the photosensitive drum charged by the charging roller does not conform to the result of the experiments (the initial setting of the apparatus) due to the long period in use (a endurance condition), a potential sensor (connected to the controller) for detecting the potential on the surface of the photosensitive drum charged by the charging roller 2 may be provided to control the difference between the potential detected by the potential sensor and the voltage applied from the power source 25 to the transfer roller 24 using the controller.

Accordingly, in the present embodiment, the density can be detected accurately even with regard to highly dense patches for detection which are transferred from a photosensitive drum to the transfer belt.

Further, according to the present embodiment, since the re-transfer phenomenon can be prevented from occurring, mixing of the colors of toner collected into the developing devices and toner originally contained in the developing devices can be prevented, and thus, poor image formation can be prevented from occurring thereafter.

Further, though, in the above description, the density control mode is described, similarly to the case of Embodiment 1, the present invention can be applied similarly to the register control mode.

In the register control mode, in ordinary image formation, the toner images for detection in the various colors (register patches) are transferred to the transfer belt 50 such that their positions are registered on the transfer material borne by the transfer belt. The register patches in the various colors are, for example, combinations of line-shaped toner images (cross marks or the like). Similarly to the case of the above-described density control mode, an optical sensor comprising of an LED as a light emitting portion and a photodiode as a light receiving portion is used. By calculating a peak of the output of the sensor (for example, a position where the two lines of a cross mark intersect each other), the center position of a register patch in the various colors is detected. After the positions of the register patches in the various colors are detected, the timing of starting to form electrostatic latent images on the respective photosensitive drums by the respective exposure devices (in the main scanning direction and/or in the sub-scanning direction) is controlled such that the positions of the toner images in the various colors transferred from the photosensitive drums to the transfer belt are registered. More specifically, control for registering the patches in the various colors is carried out by changing the timing of laser writing by the exposure devices or the like.

If the density of the register patches decreases due to the above-described re-transfer phenomenon, the center positions of the register patches which are actually detected are misaligned with the positions where the centers of the register patches should be, and thus, the accuracy of the register control is lowered, and in the worst case, the register control can not be carried out.

However, if the necessary procedures are taken with regard to the register patches in the same way as the re-transfer of the density patches is prevented in the present embodiment as described in the above, the re-transfer of the register patches can be prevented and the accuracy of the register control is prevented from decreasing.

What is claimed is:

1. An image forming apparatus comprising:

a first image bearing member for bearing an image;

a second image bearing member for bearing an image;

an intermediate transfer member;

first transfer means for transferring the image on said first image bearing member to said intermediate transfer member in a first transfer position by voltage applied to said first transfer means;

second transfer means for transferring the image on said second image bearing member to said intermediate transfer member in a second transfer position by voltage applied to said second transfer means, wherein, after images of plural colors are sequentially transferred from said first image bearing member and said second image bearing member to said intermediate transfer member in said first transfer position and said second transfer position, said images of plural colors on said intermediate transfer member are transferred to a transfer material; and detecting means for detecting a first image for detection and a second image for detection transferred from said first image bearing member and said second image bearing member to said intermediate transfer member, wherein the voltage applied to said second transfer means when said first image for detection passes through said second transfer position is zero.

2. An image forming apparatus according to claim 1, further comprising:

control means for controlling densities of images formed on said first image bearing member and said second image bearing member based on a density of said first image for detection and a density of said second image for detection detected by said detecting means.

3. An image forming apparatus according to claim 1, further comprising:

control means for controlling a timing of starting to form images on said first image bearing member and said second image bearing member based on a result of detection by said detecting means.

4. An image forming apparatus according to claim 3, wherein said control means controls the timing of starting to form images on said first image bearing member and said second image bearing member in a direction of movement of said first image bearing member and said second image bearing member.

5. An image forming apparatus according to claim 3, wherein said control means controls the timing of starting to form images on said first image bearing member and said second image bearing member in a direction perpendicular to the direction of movement of said first image bearing member and said second image bearing member.

6. An image forming apparatus according to claim 1, further comprising:

first charging means for charging a surface of said first image bearing member for a purpose of forming an image on said first image bearing member; and second charging means for charging a surface of said second image bearing member for a purpose of forming an image on said second image bearing member, wherein voltage applied to said second charging means is switched so that an intensity of an electric field formed in said second transfer position when said first image for detection passes through said second transfer position is smaller than an intensity of an electric field formed in said second transfer position when said second image for detection is transferred from said second image bearing member to said intermediate transfer member.

7. An image forming apparatus according to claim 6, wherein, voltage which is smaller in absolute value than and is at the same polarity as that of the voltage applied to said second charging means when said second image for detection is formed on said second image bearing member is applied to said second charging means so that the intensity of the electric field formed in said second transfer position when said first image for detection passes through said second transfer position is smaller than the intensity of the electric field formed in said second transfer position when said second image for detection is transferred from said second image bearing member to said intermediate transfer member.

8. An image forming apparatus according to any one of claims 1 to 5, further comprising:

first developing means for developing with toner a latent image formed on said first image bearing member; and second developing means for developing with toner a latent image formed on said second image bearing member, wherein toners on said first image bearing member and said second image bearing member are collected into said first developing means and said second developing means, respectively.

9. An image forming apparatus according to claim 8, further comprising:

first charging means for charging toner on said first image bearing member; and second charging means for charging toner on said second image bearing member;

wherein toners on said first image bearing member and said second image bearing member charged by said first charging means and said second charging means are electrostatically collected into said first developing means and said second developing means, respectively.

10. An image forming apparatus according to any one of claims 1 to 5, wherein said first image bearing member and said second image bearing member are brought into contact with said intermediate transfer member in image transfer.

11. An image forming apparatus according to any one of claims 1 to 5, further comprising:

a third image bearing member provided downstream of said second image bearing member in a direction of movement of said intermediate transfer member and for bearing an image, wherein a third image for detection is transferred from said third image bearing member to said intermediate transfer member in a third transfer position.

12. An image forming apparatus according to claim 11, wherein, in the direction of movement of said intermediate transfer member, a length of said first image for detection and a length of said second image for detection are shorter than a distance from said first transfer position to said second transfer position and a distance from said second transfer position to said third transfer position, respectively.

13. An image forming apparatus according to claim 12, further comprising:

third transfer means for transferring an image on said third image bearing member to said intermediate transfer member in said third transfer position, wherein voltage applied to said second transfer means and voltage applied to said third transfer means are switched during a period between a time when said first image for detection, said second image for detection, and said third image for detection are transferred to said intermediate transfer member by said first transfer means, said second transfer means, and said third transfer means, respectively, and a time when said first image for detection and said second image for detection pass through said second transfer position and said third transfer position, respectively.

14. An image forming apparatus according to claim 13, wherein the voltage applied to said second transfer means and the voltage applied to said third transfer means during said period are smaller in absolute value than and are at the same polarity as that of voltages applied to said second transfer means and said third transfer means when said second image for detection and said third image for detection are transferred from said second image bearing member and said third image bearing member to said intermediate transfer member, respectively.

15. An image forming apparatus according to claim 14, wherein the voltages to said second transfer means and said third transfer means are supplied by a single common power supply.

16. An image forming apparatus according to claim 15, wherein voltage applied to said first transfer means is applied by said single common power supply.

17. An image forming apparatus according to any one of claims 1 to 5, wherein said detecting means detects a density of said first image for detection after said first image for detection passes through said second transfer position.

18. An image forming apparatus comprising:

a first image bearing member for bearing an image;

a second image bearing member for bearing an image;

a transfer material bearing member for bearing a transfer material;

first transfer means for transferring the image on said first image bearing member to said transfer material bearing member in a first transfer position by voltage applied to said first transfer means;

second transfer means for transferring the image on said second image bearing member to said transfer material bearing member in a second transfer position by voltage applied to said second transfer means, wherein images of plural colors are sequentially transferred from said first image bearing member and said second image bearing member to the transfer material borne by said transfer material bearing member in said first transfer position and said second transfer position; and detecting means for detecting a first image for detection and a second image for detection transferred from said first image bearing member and said second image bearing member to said transfer material bearing member, wherein the voltage applied to said second transfer means when said first image for detection passes through said second transfer position is zero.

19. An image forming apparatus according to claim 18, further comprising:

control means for controlling densities of images formed on said first image bearing member and said second image bearing member based on a density of said first image for detection and a density of said second image for detection detected by said detecting means.

20. An image forming apparatus according to claim 18, further comprising:

control means for controlling a timing of starting to form images on said first image bearing member and said second image bearing member based on a result of detection by said detecting means.

21. An image forming apparatus according to claim 20, wherein said control means controls the timing of starting to form images on said first image bearing member and said second image bearing member in a direction of movement of said first image bearing member and said second image bearing member.

22. An image forming apparatus according to claim 20, wherein said control means controls the timing of starting to form images on said first image bearing member and said second image bearing member in a direction perpendicular to the direction of movement of said first bearing member and said second image bearing member.

23. An image forming apparatus according to claim 18, further comprising:

first charging means for charging a surface of said first image bearing member for a purpose of forming an image on said first image bearing member; and second charging means for charging a surface of said second image bearing member for a purpose of forming an image on said second image bearing member, wherein voltage applied to said second charging means is switched so that an intensity of an electric field formed in said second transfer position when said first image for detection passes through said second transfer position is smaller than an intensity of an electric field formed in said second transfer position when said second image for detection is transferred from said second image bearing member to said transfer material bearing member.

24. An image forming apparatus according to claim 23, wherein, voltage which is smaller in absolute value than and is at the same polarity as that of the voltage applied to said second charging means when said second image for detection is formed on said second image bearing member is applied to said second charging means so that the intensity of te electric field formed in said second transfer position when said first image for detection passes through said second transfer position is smaller than the intensity of the electric field formed in said second transfer position when said second image for detection is transferred from said second image bearing member to said transfer material bearing member.

25. An image forming apparatus according to any one of claims 18 to 22, further comprising:

first developing means for developing with toner a latent image formed on said first image bearing member; and second developing means for developing with toner a latent image formed on said second image bearing member, wherein toners on said first image bearing member and said second image bearing member are collected into said first developing means and said second developing means, respectively.

26. An image forming apparatus according to claim 25, further comprising:

first charging means for charging toner on said first image bearing member; and second charging means for charging toner on said second image bearing member, wherein toners on said first image bearing member and said second image bearing member charged by said first charging means and said second charging means are electrostatically collected into said first developing means and said second developing means, respectively.

27. An image forming apparatus according to any one of claims 18 to 22, wherein said first image bearing member and said second image bearing member are brought into contact with said transfer material bearing member in image transfer.

28. An image forming apparatus according to any one of claims 18 to 22, further comprising:

a third image bearing member provided downstream of said second image bearing member in a direction of conveyance of the transfer material and for bearing an image, wherein a third image for detection is transferred from said third image bearing member to said transfer material bearing member in a third transfer position.

29. An image forming apparatus according to claim 28, wherein, in the direction of conveyance of the transfer material, a length of said first image for detection and a length of said second image for detection are shorter than a distance from said first transfer position to said second transfer position and a distance from said second transfer position to said third transfer position, respectively.

30. An image forming apparatus according to claim 29, further comprising:

third transfer means for transferring an image on said third image bearing member to the transfer material borne by said transfer material bearing member in said third transfer position, wherein voltage applied to said second transfer means and voltage applied to said third transfer means are switched during a period between a time when said first image for detection, said second image for detection, and said third image for detection are transferred to said transfer material bearing member by said first transfer means, said second transfer means, and said third transfer means, respectively, and a time when said first image for detection and said second image for detection pass through said second transfer position and said third transfer position, respectively.

31. An image forming apparatus according to claim 30, wherein the voltage applied to said second transfer means and the voltage applied to said third transfer means during said period are smaller in absolute value than and are at the same polarity as that of voltages applied to said second transfer means and said third transfer means when said second image for detection and said third image for detection are transferred from said second image bearing member and said third image bearing member to said transfer material bearing member, respectively.

32. An image forming apparatus according to claim 31, wherein the voltages to said second transfer means and said third transfer means are supplied by a single common power supply.

33. An image forming apparatus according to claim 32, wherein voltage applied to said first transfer means is applied by said single common power supply.

34. An image forming apparatus according to any one of claims 18 to 22, wherein said detecting means detects a density of said first image for detection after said first image for detection passes through said second transfer position.

* * * * *

UNITED STATES PATENT AND TRADEMARK OFFICE

CERTIFICATE OF CORRECTION

PATENT NO. : 6,564,021 B1
DATED : May 13, 2003
INVENTOR(S) : Tomoaki Nakai et al.

It is certified that error appears in the above-identified patent and that said Letters Patent is hereby corrected as shown below:

Column 6,
Line 20, “above described” should read -- above-described --.

Column 12,
Line 17, “can not” should read -- cannot --.

Column 13,
Line 8, “fixed” should read -- been fixed --.

Column 16,
Line 33, “can not” should read -- cannot --.

Column 19,
Line 54, “bearing” should read -- image bearing --.

Column 20,
Line 13, “te” should read -- the --.

Signed and Sealed this

Twenty-second Day of July, 2003

JAMES E. ROGAN
*Director of the United States Patent and Trademark Office*